US008358293B2

(12) United States Patent
Seo et al.

(10) Patent No.: US 8,358,293 B2
(45) Date of Patent: Jan. 22, 2013

(54) METHOD FOR DRIVING LIGHT SOURCE BLOCKS, DRIVING UNIT FOR PERFORMING THE METHOD AND DISPLAY APPARATUS HAVING THE DRIVING UNIT

(75) Inventors: Young-Jun Seo, Seoul (KR); Dong-Min Yeo, Chungcheongnam-do (KR); Gi-Cherl Kim, Gyeonggi-do (KR); Se-Ki Park, Gyeonggi-do (KR); Hoi-Sik Moon, Chungcheongnam-do (KR)

(73) Assignee: Samsung Display Co., Ltd. (KR)

( * ) Notice: Subject to any disclaimer, the term of this patent is extended or adjusted under 35 U.S.C. 154(b) by 955 days.

(21) Appl. No.: 12/408,528

(22) Filed: Mar. 20, 2009

(65) Prior Publication Data

US 2009/0267926 A1 Oct. 29, 2009

(30) Foreign Application Priority Data

Apr. 29, 2008 (KR) ..... 10-2008-0039783
Sep. 22, 2008 (KR) ..... 10-2008-0092742

(51) Int. Cl.
*G09G 5/00* (2006.01)

(52) U.S. Cl. ..... 345/204

(58) Field of Classification Search ..... 345/204, 345/102, 89, 167, 213, 690
See application file for complete search history.

(56) References Cited

U.S. PATENT DOCUMENTS 7,932,915 B2 * 4/2011 Miyata et al. ..... 345/690
8,090,198 B2 * 1/2012 Yoshii et al. ..... 382/167
2008/0024398 A1 1/2008 Hwang
2008/0252666 A1 10/2008 Chen et al.
2009/0167658 A1 * 7/2009 Yamane et al. ..... 345/89
2010/0066721 A1 * 3/2010 Origuchi et al. ..... 345/213

FOREIGN PATENT DOCUMENTS

JP 2007-219234 8/2007
KR 1020040062152 7/2004
KR 1020050112952 12/2005

OTHER PUBLICATIONS

English Abstract for JP Pat. Pub. No. 2007-219234, 1 page, Pub date Aug. 30, 2007.
English Abstract for KR Pat. Pub. No. 1020050112952, 1 page, Pub date Jul. 7, 2004.
English Abstract for KR Pat. Pub. No. 1020040062152, 1 page, Pub date Dec. 1, 2005.

* cited by examiner

*Primary Examiner* — Fred Tzeng
(74) *Attorney, Agent, or Firm* — Innovation Counsel LLP

(57) ABSTRACT

A display apparatus includes light source blocks driven as follows in displaying at least one frame (possibly every frame). An image to be displayed includes image pixels. Each light source block corresponds to an image pixels block which is a block of image pixels to be displayed directly opposite to the light source block. For each image pixels block, a block mean value and a block maximum value are determined. A parameter is determined which corresponds to a total luminance of the frame. For each image pixels block, a block representative value is determined which corresponds to the parameter, the block representative value being within a range between the block mean value and the block maximum value inclusive. During the frame, each light source block is driven to provide a luminance which is an increasing function of the corresponding block representative value.

20 Claims, 6 Drawing Sheets

METHOD FOR DRIVING LIGHT SOURCE BLOCKS, DRIVING UNIT FOR PERFORMING THE METHOD AND DISPLAY APPARATUS HAVING THE DRIVING UNIT

PRIORITY STATEMENT

This application claims priority under 35 U.S.C. §119 and the Paris Convention to Korean Patent Applications No. 2008-39783, filed on Apr. 29, 2008, and No. 2008-92742, filed on Sep. 22, 2008 in the Korean Intellectual Property Office (KIPO), the contents of which are herein incorporated by reference in their entirety.

BACKGROUND OF THE INVENTION

1. Field of the Invention

The present invention relates to driving light source blocks of a display apparatus such as a liquid crystal display (LCD).

2. Description of the Related Art

A liquid crystal display apparatus includes an LCD panel displaying images by controlling the transmissivity of liquid crystal. A backlight unit can be placed behind the LCD panel to provide light to the LCD panel.

The LCD panel may include an array substrate having pixel electrodes and thin-film transistors (TFTs) electrically connected to the pixel electrodes, a color filter substrate having a common electrode and color filters, and a liquid crystal layer disposed between the array substrate and the color filter substrate. The orientation of the liquid crystal molecules in the liquid crystal layer is controlled by controlling the electric field between the pixel electrodes and the common electrode and thus controlling the transmission of light passing through the liquid crystal layer.

When the liquid crystal's transmissivity is maximized, the LCD panel displays a white image having a high luminance. When the transmissivity is minimized, the LCD panel must display a black image having a low luminance. However, it is difficult to cause the liquid crystal molecules to block all light for low luminance images. Light may leak out of the LCD panel, making it difficult for example to display black images. Consequently, the contrast ratio (CR) of the image displayed on the LCD panel becomes reduced.

Recently, the CR has been increased using a local dimming method. This method is applicable if the backlight unit includes a plurality of individually controlled light source blocks. If an image includes a dark portion, the corresponding light source blocks (i.e. the light source blocks located directly opposite to the dark portion) are dimmed to reduce the black portion's luminance. The CR is consequently increased.

In the local dimming method, the luminance of the light source blocks is controlled based on the pixel data, i.e. the data that define the color of each picture element (pixel) in the image. Each pixel of the image ("image pixel") corresponds to one or more pixels ("device pixels") of the LCD panel. More particularly, each image pixel corresponds to those device pixels that are used to display the image pixel. Each light source block corresponds to a device pixel block which is the device pixels region directly opposite to the light source block. The device pixels block in turn corresponds to an image pixels block which consists of image pixels displayed by the device pixels block. In the local dimming method, the luminance of the light source blocks is controlled based on the pixel data, and the pixel data (the image pixels) are then adjusted (compensated) for the dimming as needed to provide the desired image (e.g. the adjustments may be done to increase the transmissivity of some of the device pixels corresponding to dimmed light source blocks). Generally, the luminance of each light source block is set based on a mean value or a maximum value of the pixel data corresponding the light source block (i.e. the pixel data for the image pixel block corresponding to the light source block). However, when the luminance of the light source blocks is set based on the mean value of the corresponding pixel data, then bright images are displayed well, but dark images look too dark. On the other hand, when the luminance of the light source blocks is set based on the maximum value of the corresponding pixel data, and at least one pixel has a large luminance as defined by the pixel data, then the light source blocks are not effectively dimmed and therefore the local dimming process is not effective.

SUMMARY

Some embodiments of the present invention drive light source blocks to provide effective local dimming effect and high image quality for both bright and dark images.

The present invention also provides a display apparatus having the control board.

Some embodiments of the present invention provide a method for driving light source blocks of a display apparatus, the method comprising, for at least one frame: receiving an image signal defining an image to be displayed on the display apparatus during the frame, the image comprising a plurality of image pixels, wherein each light source block corresponds to an image pixels block which is a block of one or more image pixels to be displayed directly opposite to the light source block; for each image pixels block, determining, from the image signal, a block mean value and a block maximum value which are luminance-related values and are increasing functions of the luminance the image pixels block; determining, from the image signal, a parameter corresponding to a total luminance of the frame; for each image pixels block, determining a block representative value corresponding to the parameter, the block representative value being a luminance-related value within a range between the block mean value and the block maximum value inclusive; during said frame, driving each light source block to provide a luminance which is an increasing function of the corresponding block representative value.

In some embodiments, determining the parameter comprises: determining a mean luma value for said frame from the image signal; and determining the parameter as corresponding to the mean luma value.

In some embodiments, $\alpha=Z\times(1-\tau AVE/\tau MAX)$, wherein: $\alpha$ is said parameter, $\tau AVE$ is the mean luma value, $\tau MAX$ is the maximum luma value in the image signal, and Z is a predefined tuning constant and is $0<Z\leqq 1$.

In some embodiments, for each image pixels block $$BREP=(1-\alpha)\times BAVE+\alpha\times BMAX$$

wherein BREP is the block representative value,

BAVE is the block mean value, and

BMAX is the block maximum value.

In some embodiments, determining the parameter comprises: determining, from the image signal, the number of dark blocks in said frame, wherein the frame is subdivided into image blocks and wherein the dark blocks are image blocks whose maximum luminance as defined by the image data is less than or equal to a predefined reference luminance; comparing the number of the dark blocks to a reference blocks number which is a predefined number; and generating the parameter to depend on a result of the comparing.

In some embodiments, for each image pixels block, the block representative value is equal to the block maximum value if the parameter indicates that the number of the dark blocks is larger than the reference blocks number, and the block representative value is equal to the block mean value if the parameter indicates that the number of the dark blocks is smaller than the reference blocks number.

In some embodiments, determining the parameter further comprises: determining, from the image data, a difference level between a mean luminance of the frame and a maximum luminance of the frame, the mean and maximum luminances being obtained from the image data; comparing the difference level with a reference difference level which is a predefined level; and generating the parameter to have a value depending on results of the comparing of the number of the dark blocks and of the comparing of the difference level.

In some embodiments, the image data comprises (i) red pixel data defining a red intensity for each image pixel, the red intensity being the intensity of a red color, (ii) green pixel data defining a green intensity for each image pixel, the green intensity being the intensity of a green color, and (iii) blue pixel data defining a blue intensity for each image pixel, the blue intensity being the intensity of a blue color; for each image pixels block, the block mean value comprises (i) a red block mean value which is a mean value of the red intensities of the image pixels block, (ii) a green block mean value which is a mean value of the green intensities of the image pixels block, and (iii) a blue block mean value which is a mean value of the blue intensities of the image pixels block, for each image pixels block, the block maximum value comprises (i) a red block maximum value which is a maximum value of the red intensities of the image pixels block, (ii) a green block maximum value which is a maximum value of the green intensities of the image pixels block, and (iii) a blue block maximum value which is a maximum value of the blue intensities of the pixel block, for each pixel block, the block representative value comprises (i) a red block representative value which is in the range between the red block mean value and the red block maximum value inclusive, (ii) a green block representative value which is in the range between the green block mean value and the green block maximum value inclusive, and (iii) a blue block representative value which is in the range between the blue block mean value and the blue block maximum value inclusive, wherein each of the red, green and blue block representative values depends on the parameter, each light source block comprises one or more red light-emitting diodes (LEDs), one or more green LEDs, and one or more blue LEDs, and in said driving of each light source block, in each light source block, the one or more red LEDs are driven according to the corresponding image pixels block's red block representative value, the one or more green LEDs are driven according to the corresponding image pixels block's green block representative value, and the one or more blue LEDs are driven according to the corresponding image pixels block's blue block representative value.

In some embodiments, for each image pixels block, determining the block representative value comprises setting the block representative value to the block mean value or the block maximum value.

Some embodiments provide a driving unit comprising: an image signal input part receiving an image signal comprising pixel data; a block representative value generator generating a block mean value and a block maximum value from the image signal for each of light source blocks of a backlight unit, and generating a parameter corresponding to a total luminance of a frame via analyzing the image signal corresponding to the frame, so that a block representative value is generated to depend on the parameter, the block representative value being within a range between the block mean value and the block maximum value inclusive; a dimming level determining part determining a dimming level from the block representative value for each of the light source blocks and generating a dimming signal; a pixel signal output part outputting a pixel signal corresponding to the image signal to a display unit displaying an image; and a dimming signal output part outputting the dimming signal to the backlight unit.

In some embodiments, the block representative value generator comprises: a block mean value calculator calculating the block mean value for each light source block from pixel data corresponding to the light source block, the pixel data being provided by the image signal; a block maximum value detector determining the block maximum value for each light source block from the pixel data corresponding to the light source block; a parameter generator generating the parameter corresponding to the total luminance of a frame from the image signal for the frame; and a block representative value generating part selecting and outputting the block representative value.

In some embodiments, the parameter generator comprises: a luma value calculator determining a mean luma value for the frame from the pixel data for the frame; and a parameter generating part generating the parameter corresponding to the mean luma value.

In some embodiments, the parameter generator further comprises a tuning value storage part providing a tuning constant to the parameter generating part, and the parameter generating part generating the parameter corresponding to the mean luma value and the tuning constant.

In some embodiments, the parameter generator comprises: a dark block detector determining, from the pixel data of the image signal of the frame, the number of dark blocks, wherein the frame is subdivided into image blocks and wherein the dark blocks are image blocks whose maximum luminance as defined by the image data is less than or equal to a predefined reference luminance; and a parameter generating part generating the parameter to have a first value or a second value depending on a comparison between the number of the dark blocks with a reference blocks number which is a predefined number.

In some embodiments, the parameter generating part sets the parameter to the first value when the number of the dark blocks is larger than the reference blocks number, the parameter generating part sets the parameter to the first value when the number of the dark blocks is smaller than the reference blocks number, the block representative value generating part generates the block representative value as the block maximum value when the parameter has the first value, and the block representative value generating part generates the block representative value as the block mean value when the parameter has the second value.

In some embodiments, the parameter generator further comprises a difference level detector detecting a difference level between a mean luminance of the frame and a maximum luminance of the frame from the pixel data of the image signal for the frame, and the parameter generating part sets the parameter to the first value or the second value depending both on the comparison of the number of the dark blocks with the reference blocks number and on a comparison of the difference level with a reference difference level which is a predefined level.

Some embodiments further comprise a pixel data compensating part compensating the pixel data of the image signal in accordance with the dimming level for each of the light source blocks, and transmitting the compensated pixel data to the pixel signal output part.

Some embodiments also comprise the backlight unit and the display unit, the display unit displaying an image in response to the pixel signal, the backlight unit including the light source blocks individually controlled in response to the dimming signal.

In some embodiments, the pixel data corresponding to each of the light source blocks comprises red pixel data displaying a red color, green pixel data displaying a green color, and blue pixel data displaying a blue color, the block mean value comprises a red block mean value which is a mean value of the red pixel data, a green block mean value which is a mean value of the green pixel data, and a blue block mean value which is a mean value of the blue pixel data, the block maximum value comprises a red block maximum value which is a maximum value of the red pixel data, a green block maximum value which is a maximum value of the green pixel, data and a blue block maximum value which is a maximum value of the blue pixel data, the block representative value comprises a red block representative value between the red block mean value and the red block maximum value inclusive depending on the parameter, a green block representative value between the green block mean value and the green block maximum value inclusive depending on the parameter, and a blue block representative value between the blue block mean value and the blue block maximum value inclusive depending on the parameter, and each of the light source blocks comprises red LEDs driven according to the red block representative value, green LEDs driven according to the green block representative value, and blue LEDs driven according to the blue block representative value.

According to some embodiments of the present invention, a block representative value is within a range between a block mean value and a block maximum value of each of light source blocks and depends on a parameter corresponding to a total luminance of one frame, so that local dimming may be effective for both bright and dark images. For example, when the total luminance of a frame is increased (the frame is bright), the block representative value becomes close to the block mean value. When a frame's total luminance is decreased (the frame is dark), the block representative value becomes close to the block maximum value.

DESCRIPTION OF SOME EMBODIMENTS

Figure 1:
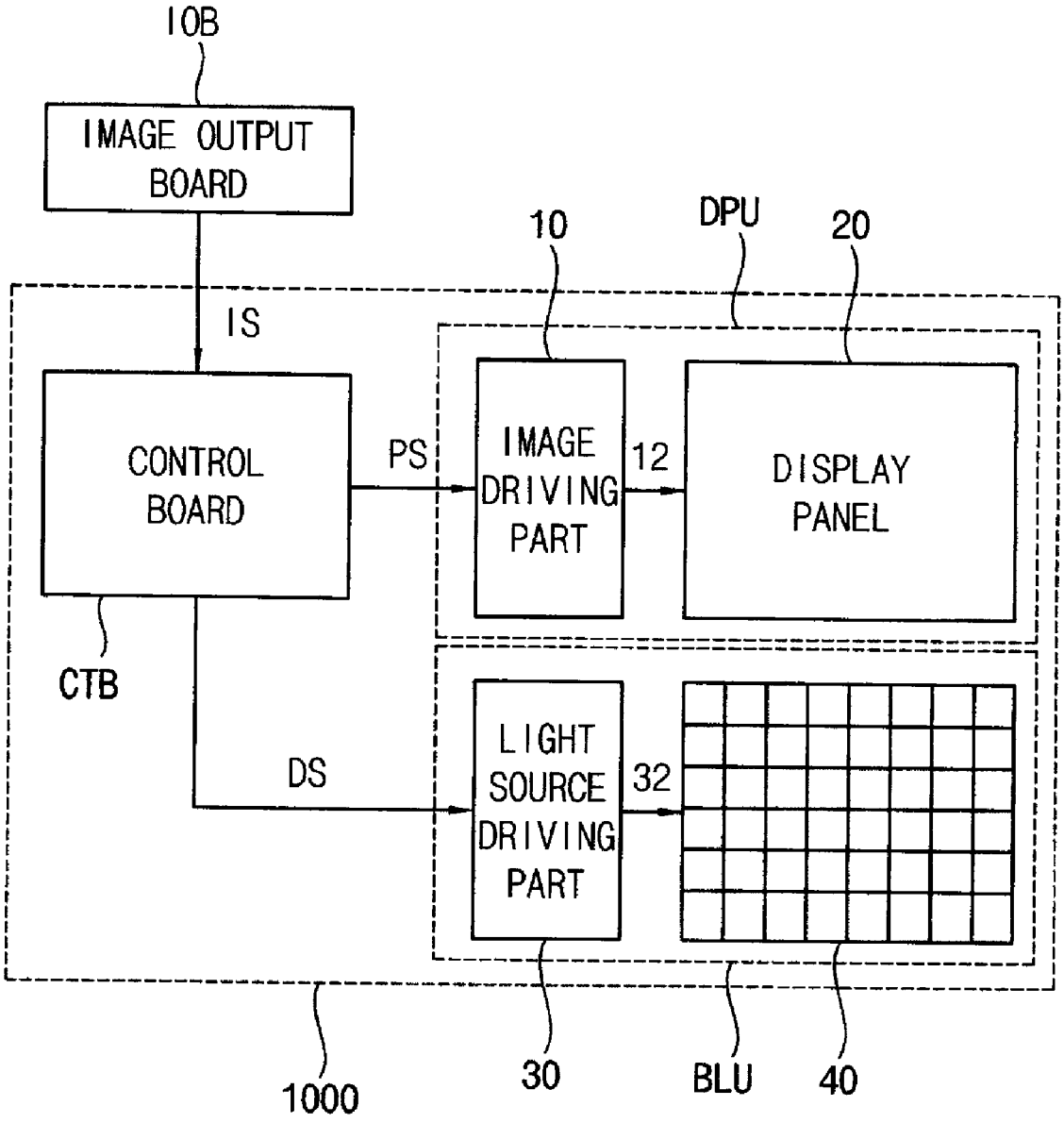
FIG. 1 is a block diagram illustrating a display apparatus according to an example embodiment of the present invention.

Some embodiments of the present invention will now be described with reference to the accompanying drawings. These embodiments do not limit the present disclosure of invention, which includes the appended claims.

In the drawings, the sizes and relative sizes of layers and regions may be exaggerated or otherwise changed for clarity.

It will be understood that when an element is referred to as being "on," "connected to" or "coupled to" another element, then intervening elements or layers may or may not be present. In contrast, the terms "directly on," "directly connected to" and "directly coupled to" mean that there are no intervening elements or layers. Like numerals refer to like elements throughout.

It will be understood that the terms "first", "second", "third", etc. may be used herein as reference labels which are interchangeable and are not limiting. These terms are simply used to distinguish one element from another.

Spatially relative terms, such as "beneath," "below," "lower," "above," "upper" and the like, may be used herein to describe one element or feature's relationship to another element(s) or feature(s) as illustrated in the figures. It will be understood that the spatially relative terms are not intended to limit the spacial orientation of the device in use or operation.

Figure 2:
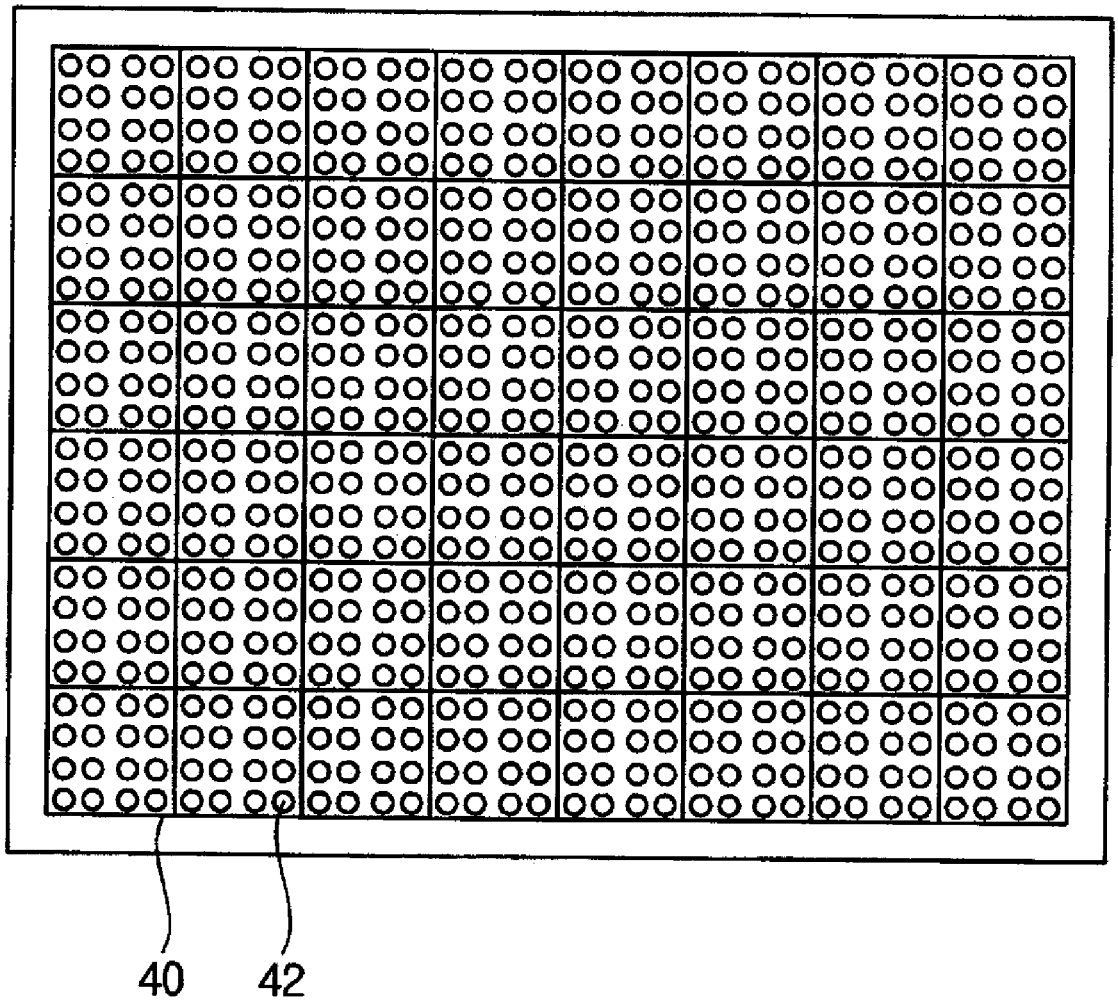
FIG. 2 is a plan view illustrating light source blocks of a backlight unit of FIG. 1.

FIG. 1 is a block diagram illustrating a display apparatus 1000 according to an example embodiment of the present invention. FIG. 2 is a plan view illustrating light source blocks of a backlight unit of FIG. 1.

In the display apparatus 1000, a control board CTB controls a display unit DPU and a backlight unit BLU. The display unit DPU displays images using light from the backlight unit BLU.

The control board CTB receives an image signal IS from an external image output board IOB. In response to the image signal IS, the control board CTB provides a pixel signal PS to the display unit DPU and provides a dimming signal DS to the backlight unit BLU.

The display unit DPU may include an image driving part 10 and a display panel 20. The image driving part 10 receives the pixel signal PS from the control board CTB, and generates an image driving signal 12 corresponding to the pixel signal PS. The display panel 20 receives the image driving signal 12 from the image driving part 10, and uses light from the backlight unit BLU to display images corresponding to the image driving signal 12.

The display panel 20 may be a liquid crystal display (LCD) panel displaying images by controlling the transmissivity of liquid crystal. For example, the display panel 20 may include a first substrate (not shown), a second substrate (not shown) facing the first substrate, and a liquid crystal layer (not shown) disposed between the first and second substrates. The first substrate may include gate lines, data lines, thin-film transistors (TFTs) and pixel electrodes, and the second substrate may include color filters over the corresponding pixel electrodes and may include a common electrode positioned over the pixel electrodes.

The backlight unit BLU may include a light source driving part 30 and a plurality of light source blocks 40. The light source driving part 30 receives the dimming signal DS from the control board CTB, and outputs light source driving signals 32 in response to the dimming signal DS. The light source blocks 40 are individually controlled by the light source driving signals 32 in emitting light. For example, the light source blocks 40 can be driven via a local dimming method.

The light source blocks 40 can be arranged in a matrix. Each of the light source blocks 40 may include a plurality of light-emitting diodes (LEDs) 42. Each light source block 40 may include red, green and blue LEDs, and/or may include white LEDs.

The image signal IS includes pixel data and various control signals. The pixel data includes (i) red pixel data defining the intensity (e.g. the power) of the red color for each image pixel, (ii) green pixel data defining the intensity of the green color for each image pixel, and (iii) blue pixel data defining the intensity of the blue color for each image pixel. The pixel data may be subdivided into separate image pixels blocks corresponding to the light source blocks 40. More particularly, each light source block 40 corresponds to a device pixels block consisting of all of the one or more device pixels directly opposite to the light source block 40. The image pixels to be displayed in each device pixels block form an image pixels block corresponding to the light source block 40.

Figure 3:
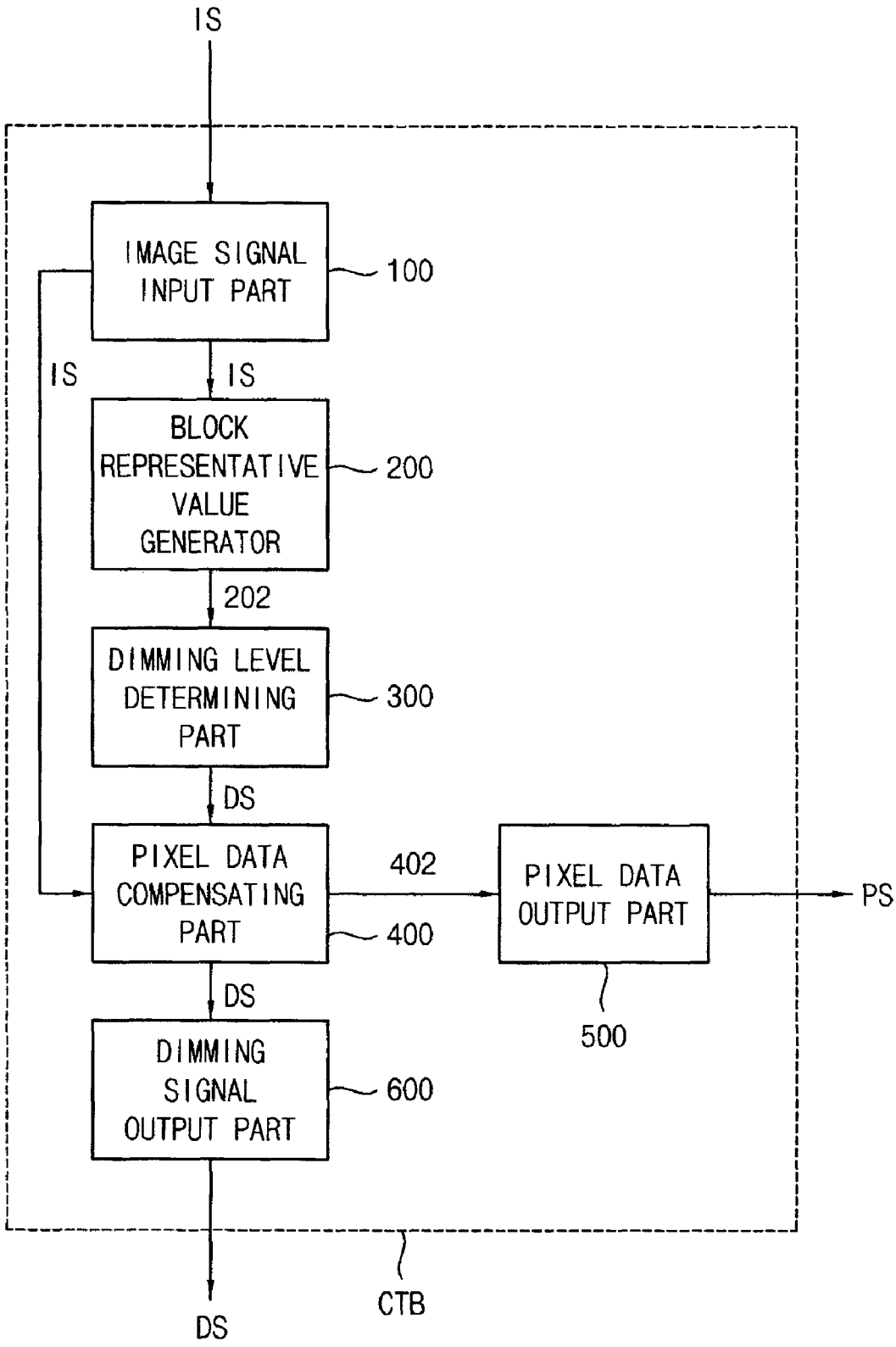
FIG. 3 is a block diagram illustrating a control board of the display apparatus of FIG. 1.

FIG. 3 is a block diagram illustrating one embodiment of the control board CTB of the display apparatus of FIG. 1.

Referring to FIGS. 1 and 3, the control board CTB may include an image signal input part 100, a block representative value generator 200, a dimming level determining part 300, a pixel data compensating part 400, a pixel signal output part 500 and a dimming signal output part 600.

The image signal input part 100 receives the image signal IS from the image output board IOB. The image signal input part 100 converts the image signal IS into voltage levels suitable for use in the control board CTB, and outputs the converted image signal IS to the block representative value generator 200 and the pixel data compensating part 400.

The block representative value generator 200 uses the pixel data in the image signal IS to generate a block representative value 202 for each light source block 40.

The dimming level determining part 300 uses the block representative values 202 from the block representative value generator 200 to generate a dimming level for each light source block 40. The dimming level defines the luminance of the light source block 40. The dimming levels may for example be generated in the form of the dimming signal DS.

The pixel data compensating part 400 receives the image signal IS from the image signal input part 100, and receives the dimming signal DS from the dimming level determining part 300. The pixel data compensating part 400 compensates the pixel data of the image signal IS in response to the dimming levels, and transmits the compensated pixel data 402 to the pixel signal output part 500. Of note, the pixel data are used to define the liquid crystal transmissivity at each device pixel, and the pixel data compensation may be done so as to increase the liquid crystal transmissivity to compensate for the dimming of the light emitting blocks 40. The pixel data compensating part 400 may be omitted in certain cases. For example, the image signal IS provided by the image signal input part 100 may be directly applied to the pixel signal output part 500 without compensation.

The pixel signal output part 500 converts the compensated pixel data 402 or the uncompensated image signal IS to suitable voltage levels shown as the pixel signal PS. The pixel signal PS may be provided, for example, to the display unit DPU.

The dimming signal output part 600 receives the dimming signal DS from the pixel data compensating part 400 as shown in FIG. 3 or directly from the dimming level determining part 300, and converts the dimming signal DS to suitable voltage levels shown as the output signal DS of the dimming signal output part 600. This output signal, given the same name DS as the input signal, can be provided, for example, to the backlight unit BLU.

Figure 4:
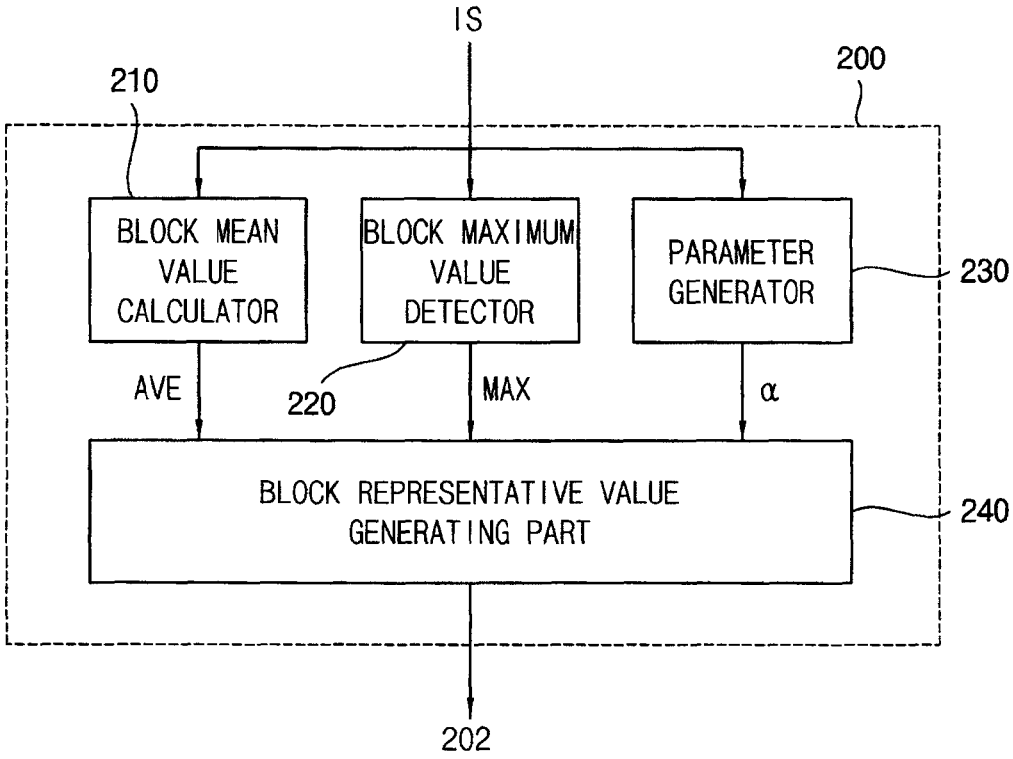
FIG. 4 is a block diagram illustrating a block representative value generator of the control board of FIG. 3.

FIG. 4 is a block diagram illustrating the block representative value generator 200 of the control board of FIG. 3. The block representative value generator 200 may include a block mean calculator 210, a block maximum value detector 220, a parameter generator 230 and a block representative value generating part 240.

The block mean value calculator 210 receives the image signal IS from the image signal input part 100, and calculates a block mean value BAVE for each of the light source blocks 40 from the pixel data of the image signal IS. For each light source block 40, the block mean value BAVE may be calculated from the corresponding image pixels block. In some embodiments, the block mean value BAVE is a mean of the primary colors' intensities of the image pixels of the image pixels block, or of some other values which indicate luminances of the image pixels of the block.

As stated above, the pixel data for each image pixel may include red pixel data indicating the intensity of the red color at the image pixel, green pixel data indicating the intensity of the green color at the image pixel, and blue pixel data indicating the intensity of the blue color at the image pixel. Accordingly in some embodiments, for each light source block 40, the block mean value BAVE is a triple of a red block mean value, a green block mean value, and a blue block mean value, which are calculated respectively as the means of the red, green and blue color intensities of the corresponding image pixels block.

The block maximum value detector 220 receives the image signal IS from the image signal input part 100, and determines the block maximum value BMAX for each of the light source blocks 40 from the pixel data of the image signal IS. In some embodiments, for each light source block 40, the block maximum value BMAX is the maximum of the primary colors' intensities of the corresponding image pixels block. In other embodiments, the block maximum value BMAX is a triple of: (i) the block maximum red value (the maximum of the red pixel data of the corresponding image pixels block), (ii) the block maximum green value (the maximum of the green pixel data of the corresponding image pixels block), and (iii) the block maximum blue value (the maximum of the blue pixel data of the corresponding image pixels block).

The parameter generator 230 receives the image signal IS from the image signal input part 100, and analyzes the pixel data of the image signal IS for each frame to generate a frame luminance parameter $\alpha$ for the frame.

Figure 6:
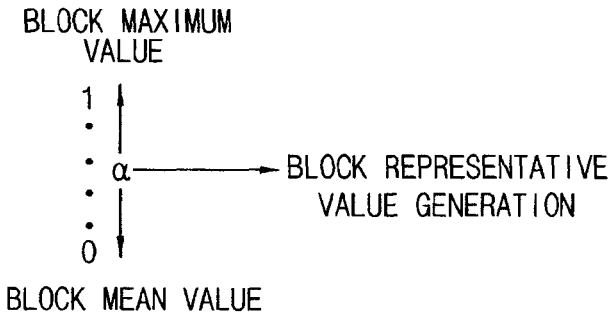
FIG. 6 is a process diagram illustrating a process for generating a block representative value of FIG. 5.

The block representative value generating part 240 generates the block representative value 202 (also denoted BREP below) within a range between the block mean value BAVE and the block maximum value BMAX depending on the parameter $\alpha$. In some embodiments, the block representative value 202 may take any value in the range between the block mean value BAVE and the block maximum value BMAX inclusive depending on the parameter $\alpha$, as illustrated in FIG. 6. As stated above, the block mean value BAVE and the block maximum value BMAX can each be a triple of values corresponding to the red, green and blue primary colors, e.g. $BAVE=(BAVE_R,BAVE_G,BAVE_B)$ and $BMAX=(BMAX_R, BMAX_G, BMAX_B)$ where the subscripts R, G, B indicate the primary colors. In this case, the block representative value $BREP=(BREP_R,BREP_G,BREP_B)$ is also a triple of values, and for each primary color i=R, G, B, the value $BREP_i$ is in the range between $BAVE_i$ and $BMAX_i$ inclusive.

Figure 5:
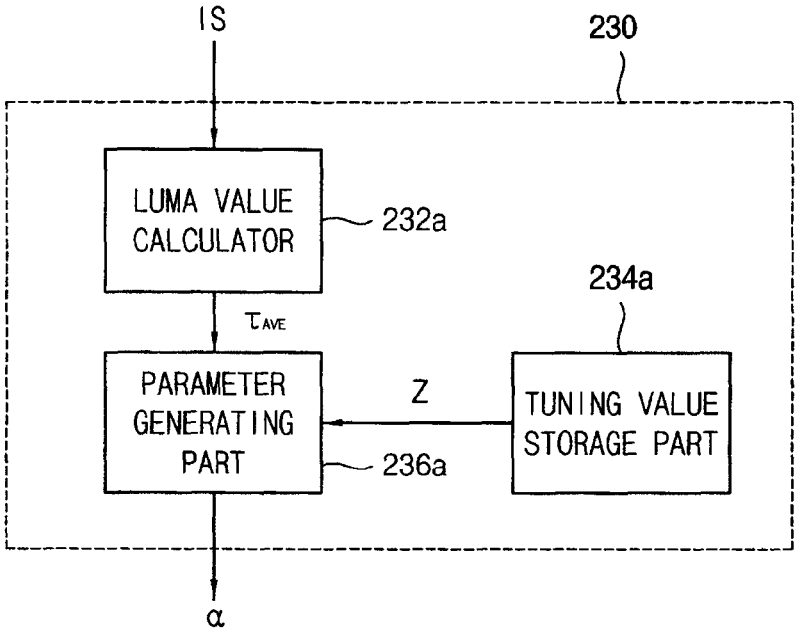
FIG. 5 is a block diagram illustrating a parameter generator of the block representative value generator of FIG. 4.

FIG. 5 is a block diagram of one embodiment of the parameter generator 230. FIG. 6 illustrates generation of the block representative value BREP from the parameter $\alpha$.

Referring to FIGS. 4, 5 and 6, the parameter generator 230 may include a luma value calculator 232*a*, a tuning value storage part 234*a* and a parameter generating part 236*a*.

The luma value calculator 232*a* calculates a mean luma value $\tau$AVE for every frame from the pixel data of the image signal IS. For example, the pixel data may be provided in sRGB format, and the luma value calculator 232*a* may convert the pixel data to the YCbCr format. In some embodiments, the luma value calculator 232*a* generates only the luma value Y of the YCbCr representation. The luma value Y is thus obtained for every image pixel of the frame. Then the luma value calculator 232*a* calculates the mean luma value τAVE as the average of the luma values Y for the frame. In some embodiments, the luma value calculator 232*a* first calculates the average luma value for the image pixels corresponding to each light block 40, and then calculates τAVE as the mean of the average values. The mean luma value τAVE thus represents the total luminance of one frame.

The tuning value storage part 234*a* stores a tuning constant Z controlling generation of the parameter α, and provides the tuning constant Z to the parameter generating part 236*a*. The tuning constant Z is between 0 and 1, and may be changed according to client's preference. Typically, the tuning constant Z is preset to the value of 1.

The parameter generating part 236*a* may generate the parameter α as a function of the mean luma value τAVE and the tuning constant Z. For example, denoting the maximum luma value of the image signal for the current frame as τMAX, the parameter α can be generated using the following Equation (1).

$$\alpha=Z\times(1-\tau AVE/\tau MAX),\ 0\leqq Z\leqq 1 \quad (1)$$

In this case, when the tuning constant Z is 1, the parameter α becomes close to 0 as the mean luma value τAVE becomes close to the maximum luma value, and the parameter α becomes close to 1 as the mean luma value τAVE becomes close to 0. If the tuning constant Z is 0.5, the parameter α becomes close to 0 as the mean luma value τAVE becomes close to the maximum luma value, and the parameter α becomes close to 0.5 as the mean luma value τAVE becomes close to 0. When the tuning constant Z is 0, the parameter α is always 0 regardless of the mean luma value τAVE.

In the present example embodiment, the tuning constant Z is typically 1, so that the parameter α is between 0 and 1. Therefore, if the total luminance of the frame is low (i.e. the frame is dark), then the parameter α is close to 1, and if the total luminance is high (i.e. the frame is bright), then the parameter α is close to 0.

The block representative value generating part 240 may generate the block representative value 202 in response to the parameter α. For example, denoting the block representative value 202 as BREP, the block representative value 202 can be generated according to the following Equation (2).

$$BREP=(1-\alpha)\times BAVE+\alpha\times BMAX \quad (2)$$

In this case, when the parameter α becomes close to 0, the block representative value 202 (BREP) becomes close to the block mean value BAVE, and when the parameter α becomes close to 1, the block representative value 202 becomes close to the block maximum value BMAX.

As stated above, if each of BAVE and BMAX is a triple of values, then the equation (2) provides a BREP as a triple of values for each of the red, green and blue primary colors. The parameter α has the same value for all the primary colors.

The light source blocks can be driven as follows. First, the image signal IS is received from outside. The image signal IS includes the pixel data and various control signals needed to display the image. The pixel data for each frame may be sub-divided into substantially equal image pixels blocks corresponding to the light source blocks 40.

Then the mean values BAVE and the maximum values BMAX are calculated from the pixel data for each image pixels block for the light source blocks 40.

In addition, the image signal IS is analyzed for each frame to calculate the parameter α corresponding to the total luminance of the frame. For example, to calculate the parameter α, the mean luma value of the frame is calculated from the pixel data in the image signal IS. The parameter α is then generated based on the mean luma value. In some embodiments, the mean luma value is calculated as the Y value of the YCbCr color space. For example, if the pixel data are in the sRGB format, then the Y value can be calculated according to the Equation (3) below. In the Equation (3), the values R, G, B are respectively the red, green, and blue coordinates of the sRGB color space.

$$Y=0.2126R+0.7152G+0.0722B \quad (3)$$

As stated above, if the frame's mean luma value is denoted as τAVE then the parameter α satisfies Equation (1) given above and repeated below. The tuning constant Z may be between 0 and 1, and is typically 1.

$$\alpha=Z\times(1-\tau AVE/\tau MAX),\ 0\leqq Z\leqq 1 \quad (1)$$

The block mean values BAVE, the block maximum values BMAX and the parameter α may be calculated in parallel or at different times.

Using the parameter α, the block representative value 202 (BREP) is determined for each light source block 40 as a value between the corresponding block mean value BAVE and block maximum value BMAX inclusive. For example, Equation (2) can be used which is given above and repeated immediately below.

$$BREP=(1-\alpha)\times BAVE+\alpha\times BMAX \quad (2)$$

As seen from equation (2), when the parameter α becomes close to 0, the block representative value 202 becomes close to the block mean value BAVE, and when the parameter α becomes close to 1, the block representative value 202 becomes close to the block maximum value BMAX.

For each light source block 40, the dimming level is determined from the corresponding block representative value 202 and is output in the form of the dimming signal DS.

The dimming signal DS defines the luminance of each light source block 40. If each light source block 40 includes red, green and blue LEDs, then the dimming signal DS may separately define the luminance of the red LEDs, the luminance of the green LEDs, and the luminance of the blue LEDs for each light source block 40. In this case, the red, green, and blue colors provided by the light source blocks 40 do not necessarily add up to white light. In other embodiments, the light source blocks 40 are driven to always provide white light (using either red, green and blue LEDs or white LEDs), and the dimming signal DS may define the luminance of the white light for each light source block 40.

Typically, the luminance of each light source block 40 is an increasing function of the corresponding block representative value BREP. If block reference value BREP is a triple of value ($BREP_R$,$BREP_G$,$BREP_B$), then the luminance of each light source block 40 is an increasing function of each of $BREP_R$, $BREP_G$, $BREP_B$. In some embodiments, the dimming signal DS separately defines the luminance of the red LEDs, the luminance of the green LEDs, and the luminance of the blue LEDs, and each block reference value BREP is a triple of value ($BREP_R$,$BREP_G$,$BREP_B$); the luminance of the red LEDs is an increasing function of the $BREP_R$ and is independent of the other two values $BREP_G$ and $BREP_B$, the luminance of the green LEDs is an increasing function of the value $BREP_G$ and is independent of the other two values $BREP_R$ and $BREP_B$, and the luminance of the blue LEDs is an increasing function of the value $BREP_B$ and is independent of the other two values $BREP_R$ and $BREP_G$. If the light source blocks 40 always emit white light (e.g. if the LEDs 42 are white or the LEDs are multicolor but are always driven to produce white light), then the signal DS may be generated for each light source block 40 based on the block's combined representative value $BREP_C$ obtained from the three BREP values $BREP_R$, $BREP_G$, $BREP_B$ for the three primary colors. For example, the combined value $BREP_C$ may be the maximum of the three $BREP_i$ values. In such cases, the luminance is an increasing function of the combined representative value $BREP_C$.

In some embodiments, the luminance DS of each light source block 40 (the same symbol DS will be used for the dimming signal and the luminance defined by the dimming signal) depends not only on the BREP values of the block but also on the BREP values of adjacent blocks. For example, the BREP or $BREP_C$ values can be subjected to spacial and temporal low-pass filtering as described, for example, in U.S. patent application Ser. No. 12/016,245, filed Jan. 18, 2008 by Chen et al., published as no. 2008/0252666 A1 on Oct. 16, 2008 and incorporated herein by reference. The spacial filtering helps suppress artifacts, and the temporal filtering helps suppress flicker. General brightness adjustment of the entire screen can also be performed as described in that patent application.

As stated above, pixel data compensating part 400 performs pixel compensation based on the DS signal. This can be done, for example, as explained in the aforementioned patent application published as no. 2008/0252666 A1. More particularly, if any light source block 40 is dimmed (i.e. its luminance is smaller than some maximum luminance used without local dimming), then the corresponding device pixels (the pixels located directly in front of the block as viewed from the user's position) are made more transmissive if possible, i.e. the corresponding R, G, B pixel data are increased if they are not at the maximum possible value. The amount by which the pixel data are increased may depend not only on the luminance of the corresponding light source block 40 but also on the luminance of other light source blocks 40. This is done because the light output by each light source block 40 may diffuse to device pixels corresponding to other light source blocks, and hence the total luminance delivered to a device pixel by the backlight unit BLU is composed of the luminance of multiple light source blocks 40.

The light source blocks 40 are driven based on the signal DS for each frame as the device pixels are controlled based on the compensated pixel data for the same frame.

The example embodiments described above set the block representative value 202 (BREP) for each of the light source blocks 40 to a value between the block mean value BAVE and the block maximum value BMAX inclusive based on the parameter $\alpha$ corresponding to the total luminance of one frame. Typically in conventional LCD devices, if the block representative value BREP is always set to the block mean value BAVE, then bright images can be displayed well but there may be problems with a dark image containing a bright portion. On the other hand, if each block representative value BREP is always set to the block maximum value BMAX, and at least one pixel in a block has a high luminance as defined by the pixel data, then local dimming is not effective. In contrast, the embodiments described above provide the representative values BREP which provide both high image quality and effective local dimming. Such values BREP are chosen between the block mean values BAVE and the block maximum values BMAX depending on the total luminance of the frame.

For example, when the parameter $\alpha$ is decreased due to an increase of the frame's total luminance (i.e. when the frame is generally bright), then the block representative value 202 (BREP) becomes close to the block mean value BAVE. As indicated above, such representative values BREP are suitable for bright images. When the parameter $\alpha$ is increased due to a decrease of the frame's total luminance (i.e. when the frame is generally dark), then the block representative value 202 becomes close to the block maximum value BMAX as suitable for high quality display of dark images. Local dimming is effective if BMAX is low.

The embodiments described above are suitable for the adaptive luminance and power control (ALPC) technology. The ALPC technology uses a local dimming method in which the luminance of the light source blocks is controlled to depend on the size of a white portion of the image. Generally, when the size of the white portion is gradually decreased, the luminance of the light source blocks corresponding to the white portion may be gradually increased using the ALPC technology.

Figure 7:
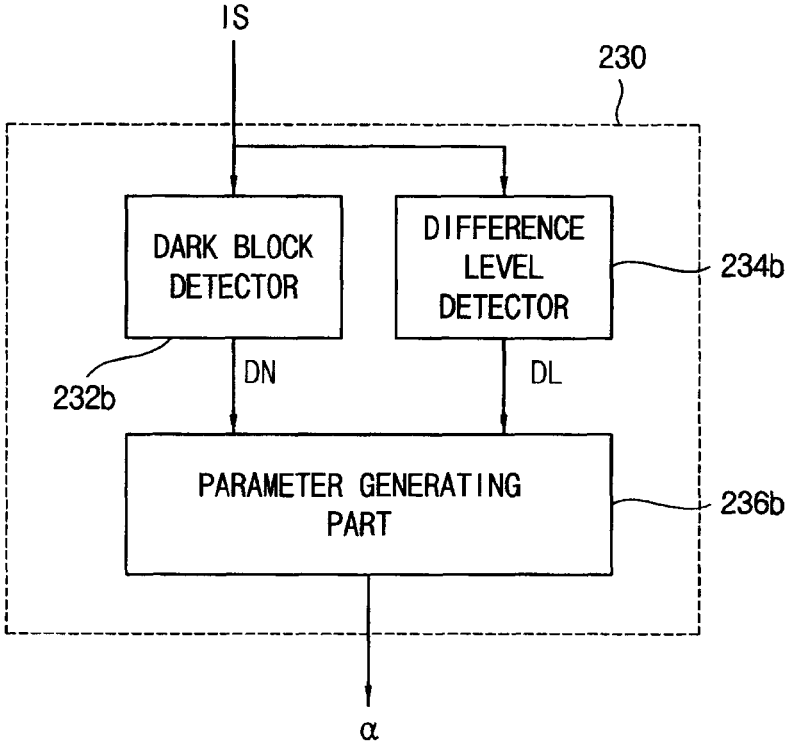
FIG. 7 is a block diagram illustrating a parameter generator of a control board of a display apparatus according to another example embodiment of the present invention.
Figure 8:
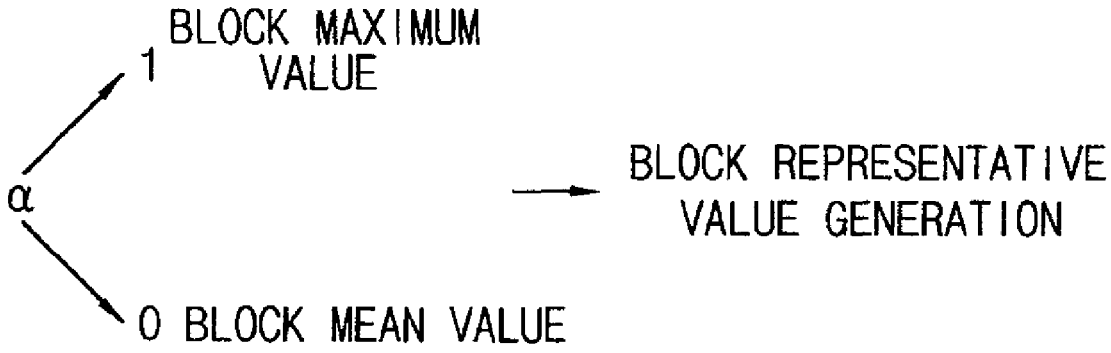
FIG. 8 is a process diagram illustrating a process for generating a block representative value of FIG. 7.

FIG. 7 is a block diagram illustrating the parameter generator 230 according to another example embodiment of the present invention. FIG. 8 illustrates generation of block representative values BREP in the embodiment of FIG. 7.

The display apparatus of the embodiment of FIGS. 7 and 8 is substantially the same as in FIGS. 1 to 6, except for the parameter generator 230. Thus, the same reference numerals will be used to refer to the same or like elements, and repetitive explanations of such elements will be avoided.

The parameter generator 230 of FIGS. 7 and 8 receives the image signal IS from the image signal input part 100, and determines the parameter $\alpha$ based on the pixel data of the image signal IS. The parameter generator 230 includes a dark block detector 232*b*, a difference level detector 234*b*, and a parameter generating part 236*b*.

In each frame, the image pixels are divided into image blocks. In some embodiments, each image block is an image pixels block corresponding to a light source block 40 as described above. However, the image blocks may be defined in a manner unrelated to the light source blocks 40. Some embodiments use 48 image blocks for a frame of 1600×1200 image pixels. Other numbers of image blocks are also possible.

For each frame, the dark block detector 232*b* analyzes the pixel data for each image block, and determines if the image block is "dark", i.e. if the image block's maximum luminance is less than or equal to some reference luminance. For each image block, the maximum luminance is the maximum of the red, green and blue intensities of the image pixels. The dark block detector 232*b* then determines the number DN of the dark blocks in the frame. For example, suppose that each of the red, green and blue intensities may range from 0 to 255 inclusive; the total number of the light source blocks is 48. Suppose the number of the light source blocks emitting the light having the luminance having intensities less than or equal to 1. Then the number DN of the dark image blocks for that frame is 30.

The difference level detector 234*b* analyzes the pixel data of the image signal IS for every frame, and determines the difference level DL between the frame's maximum luminance and the frame's mean luminance. For example, if some frame has the mean luminance of 120 and the maximum luminance of 220, then the frame's difference level DL is 100.

The parameter generating part 236*b* receives the number DN of the dark image blocks from the dark block detector 232*b* and receives the difference level DL from the difference level detector 234*b*. The parameter generating part 236*b* compares the number DN of the dark blocks to a predefined reference number ("reference blocks number" below), and compares the difference level DL to a predefined reference level ("reference difference level" below), and based on these comparisons sets the parameter $\alpha$ to a value of 0 or 1. For example, if the number DN of dark blocks is larger than the reference blocks number and the difference level DL is larger than the reference difference level, the parameter $\alpha$ is set to the value of 1, and otherwise the parameter $\alpha$ is set to the value of 0.

The difference level detector 234*b* may be omitted. Then the parameter $\alpha$ is set to 1 if the number DN of dark blocks is larger than the reference blocks number, and the parameter $\alpha$ is set to 0 if the dark blocks number DN is less than or equal to the reference blocks number.

For each light source block 40, the block representative value generating part 240 may set the block representative value 202 (BREP) to the block maximum value BMAX when the parameter $\alpha$ is 1, and may set the block representative value 202 to the block mean value BAVE if the parameter $\alpha$ is 0. Accordingly, the block representative value generating part 240 may select and output either the block maximum value BMAX or the block mean value BAVE as the block representative value 202 depending on the parameter $\alpha$.

The block maximum value BMAX, the block mean value BAVE, and the block representative value 202 (i.e. BREP) may be determined as described above in the embodiment of FIGS. 1-6.

The light source blocks 40 can be driven substantially as in the embodiment of FIGS. 1-6. More particularly, the pixel data of the image signal IS is analyzed for every frame, to determine the dark blocks number DN and, possibly, the difference level DL as described above.

Then the dark blocks number DN is compared to the reference blocks number, and possibly the difference level DL is compared to the reference difference level, to generate the parameter $\alpha$ having the value of 0 or 1.

If the parameter $\alpha$ is 1, then the block representative value 202 may be set to the block maximum value BMAX, and if the parameter $\alpha$ is 0, the block representative value 202 may be set to the block mean value BAVE. The generation of the dimming signal DS and the pixel compensation can be performed as in the embodiments of FIGS. 1-6.

In the embodiment of FIGS. 7 and 8, the parameter $\alpha$ has a value of 0 or 1 depending on the dark blocks number DN and possibly on the difference level DL, and accordingly the block representative value 202 is equal to either the block maximum value BMAX or the block mean value BAVE. Thus, each of the light source block 40 may be driven based on the block mean value BAVE in displaying a bright image, and may be driven based on the block maximum value MAX in displaying a dark image.

In the embodiments described above, for each light source block, a block representative value is set to a value between a block mean value and a block maximum value inclusive depending on a parameter corresponding to a total luminance of one frame, to make local dimming effective for both bright and dark images. For example, when a frame's total luminance increases, the block representative value becomes close to the block mean value. When a frame's total luminance decreases, the block representative value becomes close to the block maximum value. Each light source block is driven to provide luminance which roughly increases with the block representative value. Therefore, the block representative values close to the block mean value are used to display bright images, and the block representative values close to the block maximum values are used to display dark images.

The embodiments described above illustrate but do not limit the present disclosure of invention.

What is claimed is:

1. A method for driving light source blocks of a display apparatus, where the display apparatus displays images over the course of corresponding frames in whose respective time periods at least part of a respectively and then displayed image is refreshed, the method comprising, for at least one frame:

receiving an image signal defining an image to be displayed on the display apparatus during the frame, the image comprising a plurality of image pixels, wherein each light source block corresponds to an image pixels block which is a block of one or more image pixels to be displayed using light provided by the corresponding light source block;

for each image pixels block, determining, from the image signal, a block mean value and a block maximum value which are luminance-related values and are different respective functions of the to-be-displayed luminances of the image pixels of the image pixels block;

determining, from the image signal, a parameter corresponding to a total luminance of the frame;

for each image pixels block, determining a block representative value corresponding to the determined parameter, the block representative value being a luminance-related value within a range between the block mean value and the block maximum value inclusive;

during said frame, driving each light source block to provide a luminance which is a function of the corresponding block representative value.

2. The method of claim 1, wherein determining the parameter comprises:

determining a mean luma value for said frame from the image signal; and determining the parameter as corresponding to the mean luma value.

3. The method of claim 2, wherein $$\alpha=Z\times(1-\tau AVE/\tau MAX),$$

wherein: $\alpha$ is said parameter, $\tau$AVE is the mean luma value, $\tau$MAX is the maximum luma value in the image signal, and Z is a predefined tuning constant and is $0<Z\leqq 1$.

4. The method of claim 3, wherein for each image pixels block $$BREP=(1-\alpha)\times BAVE+\alpha\times BMAX$$

wherein BREP is the block representative value,

BAVE is the block mean value, and

BMAX is the block maximum value.

5. The method of claim 1, wherein determining the parameter comprises:

determining, from the image signal, a number of relatively dark blocks that are to be present in said frame, wherein the frame is subdivided into image blocks and wherein the dark blocks are image blocks whose maximum luminance as defined by the image data is less than or equal to a predefined reference luminance;

comparing the number of the dark blocks to a reference blocks number which is a predefined number; and generating the parameter to depend on a result of the comparing.

6. The method of claim 5, wherein for each image pixels block, the block representative value is equal to the block maximum value if the parameter indicates that the number of the dark blocks is larger than the reference blocks number, and the block representative value is equal to the block mean value if the parameter indicates that the number of the dark blocks is smaller than the reference blocks number.

7. The method of claim 5, wherein determining the parameter further comprises:

determining, from the image data, a difference level between a mean luminance of the frame and a maximum luminance of the frame, the mean and maximum luminances being obtained from the image data;

comparing the difference level with a reference difference level which is a predefined level; and generating the parameter to have a value depending on results of the comparing of the number of the dark blocks and of the comparing of the difference level.

8. The method of claim 1, wherein:

the image data comprises (i) red pixel data defining a red intensity for each image pixel, the red intensity being the intensity of a red color, (ii) green pixel data defining a green intensity for each image pixel, the green intensity being the intensity of a green color, and (iii) blue pixel data defining a blue intensity for each image pixel, the blue intensity being the intensity of a blue color;

for each image pixels block, the block mean value comprises (i) a red block mean value which is a mean value of the red intensities of the image pixels block, (ii) a green block mean value which is a mean value of the green intensities of the image pixels block, and (iii) a blue block mean value which is a mean value of the blue intensities of the image pixels block, for each image pixels block, the block maximum value comprises (i) a red block maximum value which is a maximum value of the red intensities of the image pixels block, (ii) a green block maximum value which is a maximum value of the green intensities of the image pixels block, and (iii) a blue block maximum value which is a maximum value of the blue intensities of the pixel block, for each pixel block, the block representative value comprises (i) a red block representative value which is in the range between the red block mean value and the red block maximum value inclusive, (ii) a green block representative value which is in the range between the green block mean value and the green block maximum value inclusive, and (iii) a blue block representative value which is in the range between the blue block mean value and the blue block maximum value inclusive, wherein each of the red, green and blue block representative values depends on the parameter, each light source block comprises one or more red light-emitting diodes (LEDs), one or more green LEDs, and one or more blue LEDs, and in said driving of each light source block, in each light source block, the one or more red LEDs are driven according to the corresponding image pixels block's red block representative value, the one or more green LEDs are driven according to the corresponding image pixels block's green block representative value, and the one or more blue LEDs are driven according to the corresponding image pixels block's blue block representative value.

9. The method of claim 1, wherein for each image pixels block, the determining of the corresponding block representative value comprises setting the block representative value to the block mean value or to the block maximum value.

10. The method of claim 1, wherein the block representative value is determined by selecting one of the block mean value and the block maximum value as the block representative value, or by selecting a predetermined value between the block mean value and the block maximum value as the block representative value.

11. A driving unit comprising:

an image signal input part receiving an image signal comprising pixel data;

a block representative value generator generating a block mean value and a block maximum value from the image signal for each of light source blocks of a backlight unit, and generating a parameter corresponding to a total luminance of a frame via analyzing the image signal corresponding to the frame, so that a block representative value is generated to depend on the parameter, the block representative value being within a range between the block mean value and the block maximum value inclusive;

a dimming level determining part determining a dimming level from the block representative value for each of the light source blocks and generating a dimming signal;

a pixel signal output part outputting a pixel signal corresponding to the image signal to a display unit displaying an image; and a dimming signal output part outputting the dimming signal to the backlight unit.

12. The driving unit of claim 11, wherein the block representative value generator comprises:

a block mean value calculator calculating the block mean value for each light source block from pixel data corresponding to the light source block, the pixel data being provided by the image signal;

a block maximum value detector determining the block maximum value for each light source block from the pixel data corresponding to the light source block;

a parameter generator generating the parameter corresponding to the total luminance of a frame from the image signal for the frame; and a block representative value generating part selecting and outputting the block representative value.

13. The driving unit of claim 12, wherein the parameter generator comprises:

a luma value calculator determining a mean luma value for the frame from the pixel data for the frame; and a parameter generating part generating the parameter corresponding to the mean luma value.

14. The driving unit of claim 13, wherein the parameter generator further comprises a tuning value storage part providing a tuning constant to the parameter generating part, and the parameter generating part generating the parameter corresponding to the mean luma value and the tuning constant.

15. The driving unit of claim 12, wherein the parameter generator comprises:

a dark block detector determining, from the pixel data of the image signal of the frame, the number of dark blocks, wherein the frame is subdivided into image blocks and wherein the dark blocks are image blocks whose maximum luminance as defined by the image data is less than or equal to a predefined reference luminance; and a parameter generating part generating the parameter to have a first value or a second value depending on a comparison between the number of the dark blocks with a reference blocks number which is a predefined number.

16. The driving unit of claim 15 wherein the parameter generating part sets the parameter to the first value when the number of the dark blocks is larger than the reference blocks number, the parameter generating part sets the parameter to the first value when the number of the dark blocks is smaller than the reference blocks number, the block representative value generating part generates the block representative value as the block maximum value when the parameter has the first value, and the block representative value generating part generates the block representative value as the block mean value when the parameter has the second value.

17. The driving unit of claim 15, wherein the parameter generator further comprises a difference level detector detecting a difference level between a mean luminance of the frame and a maximum luminance of the frame from the pixel data of the image signal for the frame, and the parameter generating part sets the parameter to the first value or the second value depending both on the comparison of the number of the dark blocks with the reference blocks number and on a comparison of the difference level with a reference difference level which is a predefined level.

18. The driving unit of claim 11, further comprising a pixel data compensating part compensating the pixel data of the image signal in accordance with the dimming level for each of the light source blocks, and transmitting the compensated pixel data to the pixel signal output part.

19. A display apparatus comprising:

a driving unit receiving an image signal from outside and outputting a pixel signal and a dimming signal, the control board comprising:

an image signal input part receiving an image signal comprising pixel data;

a block representative value generator generating a block mean value and a block maximum value from the image signal for each of light source blocks of a backlight unit, and generating a parameter corresponding to a total luminance of a frame via analyzing the image signal corresponding to the frame, so that a block representative value is generated to depend on the parameter, the block representative value being within a range between the block mean value and the block maximum value inclusive;

a dimming level determining part determining a dimming level from the block representative value for each of the light source blocks and generating a dimming signal;

a pixel signal output part outputting a pixel signal corresponding to the image signal to a display unit displaying an image; and a dimming signal output part outputting the dimming signal to the backlight unit;

a display unit being displaying an image in response to the pixel signal; and a backlight unit including the light source blocks individually controlled in response to the dimming signal.

20. The display apparatus of claim 19, wherein the pixel data corresponding to each of the light source blocks comprises red pixel data displaying a red color, green pixel data displaying a green color, and blue pixel data displaying a blue color, the block mean value comprises a red block mean value which is a mean value of the red pixel data, a green block mean value which is a mean value of the green pixel data, and a blue block mean value which is a mean value of the blue pixel data, the block maximum value comprises a red block maximum value which is a maximum value of the red pixel data, a green block maximum value which is a maximum value of the green pixel data and a blue block maximum value which is a maximum value of the blue pixel data, the block representative value comprises a red block representative value between the red block mean value and the red block maximum value inclusive depending on the parameter, a green block representative value between the green block mean value and the green block maximum value inclusive depending on the parameter, and a blue block representative value between the blue block mean value and the blue block maximum value inclusive depending on the parameter, and each of the light source blocks comprises red LEDs driven according to the red block representative value, green LEDs driven according to the green block representative value, and blue LEDs driven according to the blue block representative value.

* * * * *